US005797298A

United States Patent [19]

Grevel

[11] Patent Number: 5,797,298

[45] Date of Patent: Aug. 25, 1998

[54] FUSE PULLING DEVICE HAVING SAFETY BLOCKOUT AND FUSE HOLDER FEATURES

[76] Inventor: Gerald A. Grevel, P.O. Box 453, Pinconning, Mich. 48650

[21] Appl. No.: 774,518

[22] Filed: Dec. 30, 1996

Related U.S. Application Data

[60] Provisional application No. 60/010,638 Jan. 26, 1996.

[51] Int. Cl.[6] ..... B25B 27/14

[52] U.S. Cl. ..... 81/3.8; 439/148

[58] Field of Search ..... 7/107; 81/3.8, 81/278, 280, 758; 29/764, 698, 831, 148; 439/491, 833; 361/835; 337/211; 294/99.2

[56] References Cited

U.S. PATENT DOCUMENTS

| | | | |
|---|---|---|---|
| D. 301,675 | 6/1989 | Pearse et al. . | |
| 1,481,517 | 1/1924 | Kurz | 81/3.8 |
| 1,531,567 | 3/1925 | Niblock | 81/3.8 |
| 1,633,971 | 6/1927 | Baxter | 361/835 |
| 3,215,006 | 11/1965 | Urani | 81/3.8 |
| 3,654,824 | 4/1972 | Reed | 81/3.8 |
| 4,020,846 | 5/1977 | Stokes | 294/99.2 |
| 4,094,212 | 6/1978 | Hyams et al. | 81/3.8 |
| 4,244,613 | 1/1981 | Tillman . | |
| 4,266,184 | 5/1981 | Devine . | |
| 4,288,138 | 9/1981 | Berry et al. . | |
| 4,429,936 | 2/1984 | Rusenko et al. . | |
| 4,541,311 | 9/1985 | Trammell, Jr. . | |
| 4,669,794 | 6/1987 | Benda . | |
| 4,671,588 | 6/1987 | Fritsch et al. . | |
| 4,841,819 | 6/1989 | Williams . | |
| 4,938,715 | 7/1990 | Jones et al. . | |
| 5,002,505 | 3/1991 | Jones et al. . | |
| 5,076,118 | 12/1991 | Lawson . | |
| 5,207,590 | 5/1993 | Benda . | |
| 5,267,493 | 12/1993 | Yamagata et al. . | |
| 5,472,450 | 12/1995 | Mena | 294/99.2 |
| 5,566,445 | 10/1996 | Piao | 29/758 |

*Primary Examiner*—D. S. Meislin
*Assistant Examiner*—Joni B. Danganan
*Attorney, Agent, or Firm*—Reising, Ethington, Learman & McCulloch, PLLC

[57] ABSTRACT

A one-piece molded plastic fuse handling tool includes a pair of spring arms that diverge outwardly from a base portion to free ends defining a constantly widening gap between the arms. A pair of opposed fuse-gripping jaws are provided across the gap adjacent the free ends of the arms and another set of opposed fuse retaining seats are provided a location intermediate the jaws and the base portion. The jaws are closeable about a fuse by pinching the arms together enabling the fuse to be removed from its spring clip. Once removed, the fuse is secured to the tool by sliding it into the narrowing gap into position between the retaining seats. A block-out portion projects from the base portion and is configured for installation within the vacant fuse clip so as to disable the fuse clip to prevent inadvertent reinstallation of the fuse therein, while storing the fuse in adjacent proximity to the fuse clip.

15 Claims, 2 Drawing Sheets

FUSE PULLING DEVICE HAVING SAFETY BLOCKOUT AND FUSE HOLDER FEATURES

This is a continuation of provisional application Ser. No. 60/010,638 filed on Jan. 26, 1996.

This invention relates to hand tools and particularly fuse pulling devices used by electrical maintenance contractors for removing and replacing fuses of electrical equipment.

BACKGROUND OF THE INVENTION

When various types of electrical equipment are installed, removed, or repaired, it is necessary to deenergize the electrical circuit which most often is done by removing one or more fuses associated with the particular electrical circuit that is to be deenergized. The removal of the fuse is usually performed with the aid of a pliers-like fuse removal tool, which are costly and awkward to operate. Once removed, the fuse must be stored in an appropriate location while the maintenance work is being performed for subsequent reinstallation when the work is completed. It is common practice to lay the removed fuse on a surface adjacent the fuse block to avoid misplacement. It is possible, however, that the fuse could roll off its support surface and fall to the floor and break or, perhaps, land on energized electrical circuits causing potential injury to persons or to equipment. Others store the fuse in their shirt pocket and often times the fuse falls out when the electrician bends over where it falls to the floor and breaks. This prolongs the downtime while the electrician takes time to locate a new fuse. Such fuses are also quite costly to replace. It would be desirable, therefore, to provide a safe and secure storage place for the fuse while it is removed from its fuse clip.

Federal regulations require that the vacant fuse clip be blocked to prevent inadvertent replacement of the fuse while the work is being performed and further that a suitable warning tag be provided to alert others that work is being performed and not to reinstall the fuse. The known blockout devices are relatively small and, consequently, are difficult to handle and install in the fuse clip while wearing protective gloves. Installing such blockout devices without protective gloves poses great danger to the electrician since his hands must necessarily come close to the energized portion of the fuse clip. The warning tag is most often attached directly to the fuse clip, posing the same dangers to the electrician as those mentioned above.

SUMMARY OF THE INVENTION AND ADVANTAGES

The present invention overcomes the problems associated with the prior art fuse pulling and blockout devices by providing a multi-function tool fabricated of an insulating material such as a thermoplastics material, having a pair of resilient arms for removing and installing fuses in a fuse clip of an electrical circuit, a unitary block-out portion installable into the fuse clip to prevent inadvertent reinsertion of a fuse that has been removed for the purpose of disabling the electrical circuit, a unitary fuse storage portion to releasably hold the fuse in an adjacent but safe and secure location adjacent the fuse clip from which it was removed to prevent the fuse from being damaged or falling into an area where it could cause harm to the equipment or persons in the area, and a unitary warning tag attachment portion enabling a suitable warning tag to be attached to the device at a safe location well spaced from the fuse clip in order to warn others that the fuse is intentionally removed and not to be reinstalled while work is being performed on the electrical circuit.

The tool is easy to use even with safety gloves on and can be operated with one hand. The tool is of a one-piece molded plastics construction and is inexpensive to manufacture and very durable.

THE DRAWINGS

The presently preferred embodiment of the invention is disclosed in the following description and in the accompanying drawings, wherein.

DETAILED DESCRIPTION

Figure 1:
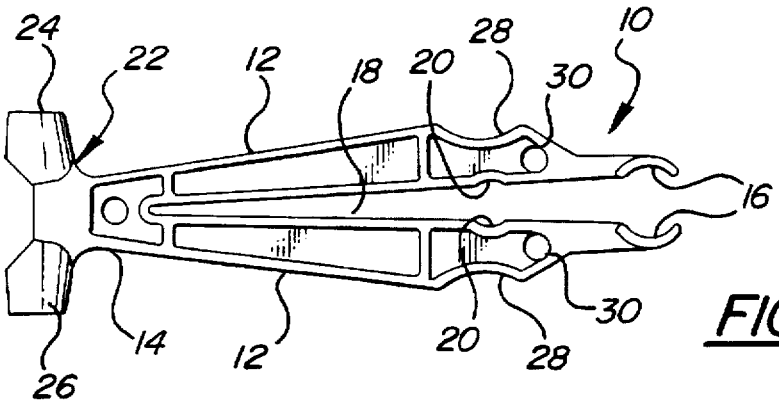
FIG. 1 is a front view of a multipurpose tool constructed according to the invention.

A multi-function tool constructed in accordance with a presently preferred embodiment of the invention is illustrated in the drawings and indicated generally by the reference numeral 10. The tool device 10 is of a one-piece unitary construction fabricated of a non-conducting material and preferably an injection molded thermoplastics material such as polypropylene.

The device 10 is preferably symmetrical in design and includes a pair of identical opposing spaced apart resilient spring arms 12 that extend longitudinally in generally outwardly diverging relation to one another from a base portion 14 of the device and terminate at their free ends in a pair of diametrically opposed arcuate jaws 16. The divergent relation of the arms 12 provides an open channel or gap between the arms 12 that is generally V-shaped and is narrowest adjacent the base 14 of the tool and progressively widens to its greatest spacing at the free ends of the arms adjacent the jaws 16. A pair of opposing arcuate seats 20 are provided in the arms 12 within the channel 18 rearwardly of the jaws 16 and, as illustrated in FIG. 1, are spaced closer to one another than the spacing between the jaws 16.

A fuse clip block-out portion is molded on the base 14 and includes a pair of aligned cylindrical projections 24, 26 having a size and shape corresponding generally to the metal end caps of a conventional fuse utilized in most electrical equipment.

A pair of recessed finger grips 28 are molded into the arms 12 in opposing relation to one another on the outer surface of the arms 12 adjacent their free ends and each arm 12 is provided, as well, with warning tag attachment portions in the preferred form of apertures 30 adjacent their free ends.

Figure 2:
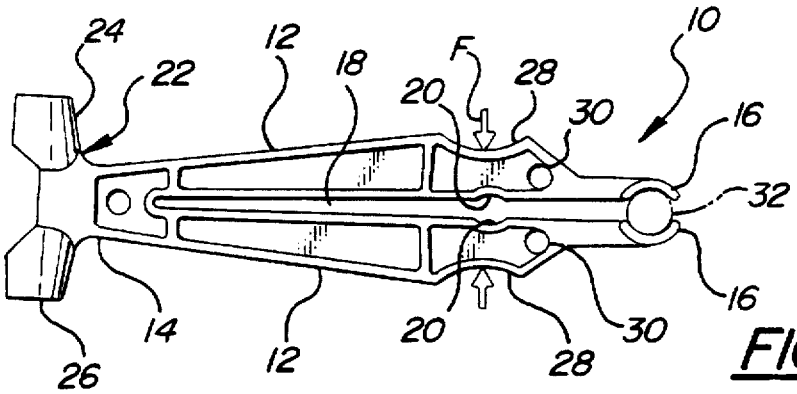
FIG. 2 is a view like FIG. 1, but showing the tool in a fuse-gripping position.
Figure 5:
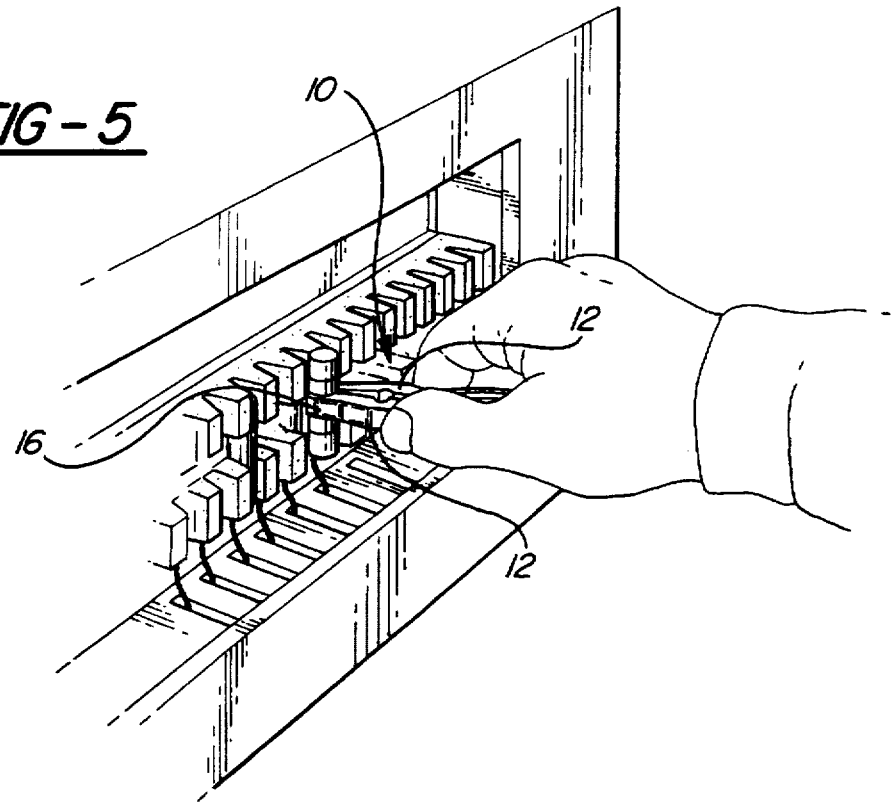
FIG. 5 is an illustration showing the tool being used to remove a fuse from a fuse clip.

In use, a fuse 32 is removed from its associated fuse clip 34 which forms part of a fuse block 36 of an electrical circuit, by extending the free ends of the arms 12 toward the fuse clip 34 and guiding the cylindrical midsection or body of the fuse 32 into the channel 18 between the arms 12 in alignment with the jaws 16. The user then exerts a pinching force F (FIG. 2) at the finger grips 28 with the finger and thumb of the same hand to deflect the arms 12 inwardly and close the jaws 16 about the fuse and capture the fuse with sufficient force to enable the user to pull the fuse outwardly of the fuse block 36 to remove the fuse 32 from its clip 34, as illustrated in FIG. 5.

Figure 3:
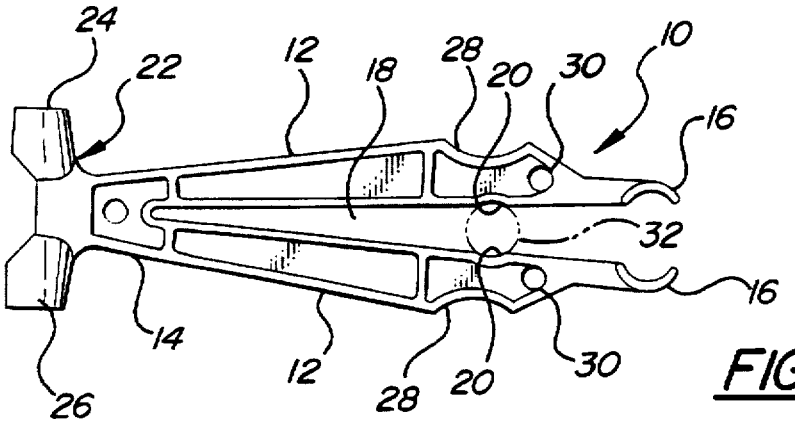
FIG. 3 is a view like FIG. 1, but showing the tool in a fuse-storage condition.

Once removed, the user grasps the fuse 32 with his opposite hand and releases the applied force to the grips 28 causing the arms 12 to return outwardly to their unstressed position. The user then guides the fuse out of the jaws 16 deeper into the channel 18 forcing the arms 12 further apart until the fuse 32 is guided into the retaining seats 20 as illustrated in FIG. 3. The resilient nature of the arms 12 acts to bias the arms 12 constantly inwardly exerting a force on the fuse 32 to hold and retain it securely but releasably in the seats 20 of the arms 12 until it is ready to be reinstalled.

Figure 4:
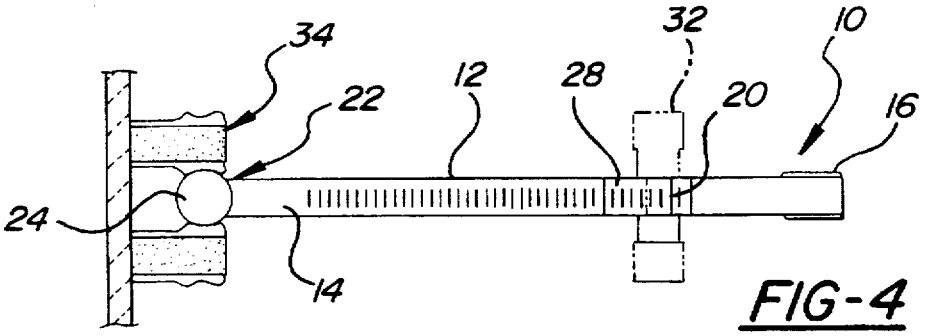
FIG. 4 is a top view of the device of FIG. 3 shown installed in a fuse clip from which the fuse held by the tool was removed.
Figure 6:
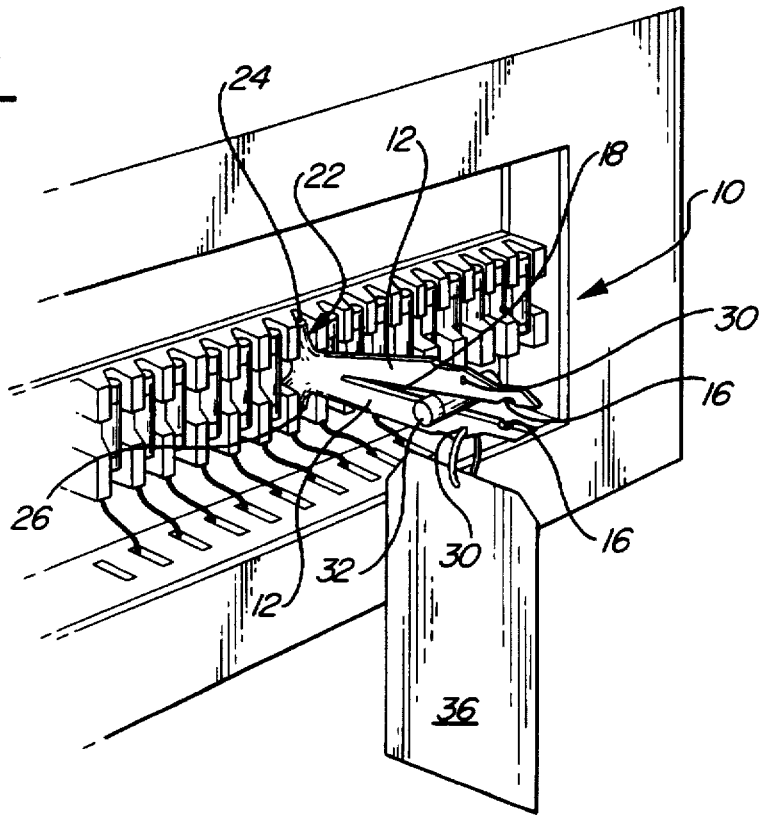
FIG. 6 is an illustration of the tool shown storing a removed fuse with the blockout portion of the tool installed in the fuse clip from which the fuse was removed and supporting a suitable warning tag.

The vacant fuse clip 34 is blocked out or plugged by grasping the arms 12 and guiding the cylindrical portions 24, 26 of the block-out portion 22 of the tool into the fuse clip, as illustrated in FIGS. 4 and 6, to render the disabled circuit safe and, at the same time, securely supporting the removed fuse 32 in a safe but nearby location adjacent the vacated fuse clip 34 from which it was removed. As also illustrated in FIG. 6, a suitable warning tag 38 may be attached to one of the mounting holes 30 by threading a string or nylon tie through the hole at a convenient and safe location spaced from the fuse clip 34, but yet still associated with the vacated fuse clip to provide the appropriate warning.

After the service has been performed, the fuse 32 can be reinstalled in its fuse clip 34 by simply pulling the cylindrical portions 24, 26 out of the fuse clip 34, sliding the fuse 32 out of the retaining seats 20 to a position between the jaws 16 and extending the fuse back into the fuse clip 34 while exerting a sufficient clamping force F at the finger grips 28.

As mentioned, the tool 10 preferably is symmetrical in its construction. This makes the tool easier to use since the electrician can turn the tool either way to remove the fuse, as illustrated in FIG. 5 and, further, can turn the tool either way to block out the vacated fuse clip, as illustrated in FIG. 6.

Accordingly, the invention provides a safe, inexpensive and durable tool for the removal and installation of cylindrical objects and, particularly, fuses while providing a convenient, safe and secure storage location for the removed fuse and a blockout feature for disabling the vacated fuse clip 34. The tool is of a small, compact design enabling it to be stored in a shirt pocket or a tool belt and the resilient nature of the arms enables the tool to be operated easily with only one hand enabling a controlled amount of force to be exerted on the fuse during removal or installation. The tool is made of a non-conductive and, preferably, thermoplastics material that advantageously can be dyed with a bright color, such as yellow or red, to enhance the effectiveness of the warning by attracting the attention of those in the area and warn them that the electrical system is being worked on.

The disclosed embodiment is representative of a presently preferred form of the invention, but is intended to be illustrative rather than definitive thereof. The invention is defined in the claims.

I claim:

1. A one-piece fuse handling tool comprising:

a base portion;

a pair of laterally spaced resilient spring arms extending from said base portion to free ends thereof;

fuse gripping jaws provided adjacent said free ends and closable about a fuse removably installed in a retainer clip of a fuse block by extending said free ends over the fuse and bodily forcing said arms laterally inwardly the body so as to capture the fuse between said jaws enabling subsequent removal of the fuse from the retainer clip by exerting a bodily pulling force on said tool outwardly of the fuse block;

laterally opposed fuse retaining seats provided on said arms intermediate said base portion and said gripping jaws to receive and self-retain the removed fuse between said seats in response to bodily forcing the removed fuse along said arms into position between said retaining seats; and a fuse clip block-out portion installable within the vacant fuse clip from which the fuse was removed to support the removed fuse in close proximity to the corresponding fuse clip while temporarily disabling the fuse clip to prevent inadvertent reinstallation of the fuse said block-out portion comprising a pair of aligned cylindrical projections extending from said base portion.

2. The tool of claim 1 wherein said arms define a longitudinal gap therebetween that widens in the direction from said base to said free ends.

3. The tool of claim 2 wherein said gripping jaws are spaced laterally by a distance greater than that of said retaining seats.

4. The tool of claim 3 wherein said gripping jaws and said retaining seats comprise laterally opposed sets of arcuate detents.

5. The tool of claim 4 wherein said arms are constantly biased laterally inwardly when the fuse is received between said retaining seats to self-secure the fuse releasably in position between said seats.

6. The tool of claim 1 wherein said tool includes a warning tag attachment portion for supporting a warning tag when said tool is installed in the fuse clip.

7. The tool of claim 6 wherein said warning tag attachment portion comprises at least one aperture formed in said arms adjacent said free ends thereof.

8. The tool of claim 1 wherein said tool is symmetrical.

9. The tool of claim 1 wherein said tool is fabricated of non-conductive molded plastics material.

10. A one-piece fuse handling tool comprising:

a base portion;

a pair of resilient spring arms extending from said base in outwardly diverging relation to one another to free ends thereof defining a longitudinal gap between said arms that is constantly widening from a narrowest point adjacent said base to a widest point adjacent said free ends;

a pair of arcuate jaws formed in said arms adjacent said free ends in laterally opposed relation across said gap providing a detent between said arms having a lateral spacing when said arms are unstressed that is generally greater than the diameter of a fuse to be handled by said tool, said jaws being closable about a fuse removably installed in a retainer clip of a fuse block by extending said free ends over the fuse and bodily flexing said arms laterally inwardly so as to capture the fuse between said jaws enabling subsequent removal of the fuse from the retainer clip by exerting a bodily pulling force on said tool outwardly of the fuse block;

a pair of arcuate retaining seats formed in said arms across said gap at a location intermediate said jaws and said base portion, said retaining seats being spaced laterally closer to one another than that of said jaws, said arms being deflectable laterally outwardly in response to sliding the removed fuse along said gap from said jaws toward said base and returning inwardly upon aligning the fuse with said retaining seats to bias said retaining seats constantly inwardly against the fuse to self-retain the fuse securely but releasably in position between said retaining seat; and a fuse clip block-out portion projecting from said base portion configured for installation within the vacant fuse clip from which the fuse was removed for supporting the removed fuse in adjacent proximity to its associated fuse clip while disabling the fuse clip to prevent inadvertent reinstallation of the fuse within the fuse clip said block-out portion comprising a pair of aligned cylindrical projections extending from said base portion.

11. The tool of claim 10 wherein said tool is molded non-conductive plastics material.

12. The tool of claim 10 including a warning tag attachment portion for supporting a warning tag adjacent the vacant fuse clip when said tooled is installed in the fuse clip.

13. The tool of claim 12 wherein said warning tag attachment portion comprises at least one aperture formed in said arms adjacent said free ends thereof.

14. The tool of claim 10 wherein said tool is longitudinally symmetrical.

15. A method of handling a fuse installed in a fuse clip of a fuse block using a one-piece tool, said method comprising:

grasping the fuse with the tool and pulling the fuse free of the fuse clip;

securing the removed fuse releasably to the tool; and extending a block-out portion of the tool into the vacant fuse clip from which the fuse was removed to support the fuse in adjacent proximity to the associated fuse clip while disabling the fuse clip to prevent inadvertent reinstallation of the fuse.

* * * * *